US006994123B2

(12) United States Patent
Mettler

(10) Patent No.: US 6,994,123 B2
(45) Date of Patent: Feb. 7, 2006

(54) SUPPORT ELEMENT FOR A HEDDLE FRAME

(75) Inventor: Franz Mettler, Wollerau (CH)

(73) Assignee: Grob Horgen AG, Horgen (CH)

( * ) Notice: Subject to any disclaimer, the term of this patent is extended or adjusted under 35 U.S.C. 154(b) by 355 days.

(21) Appl. No.: 10/283,191

(22) Filed: Oct. 30, 2002

(65) Prior Publication Data

US 2003/0079793 A1 May 1, 2003

(30) Foreign Application Priority Data

Oct. 31, 2001 (DE) ..... 101 53 729

(51) Int. Cl.
*D03C 9/00* (2006.01)

(52) U.S. Cl. ..... 139/93
(58) Field of Classification Search ..... 139/91–93, 139/55.1
See application file for complete search history.

(56) References Cited

U.S. PATENT DOCUMENTS 4,112,980 A * 9/1978 Bader ..... 139/92
4,144,910 A * 3/1979 Bader ..... 139/91
4,484,604 A 11/1984 Kramer et al. ..... 139/92
4,790,357 A 12/1988 Kramer ..... 139/91
4,844,130 A * 7/1989 Blontrock ..... 139/92
4,913,193 A 4/1990 Faasse ..... 139/91
5,178,192 A * 1/1993 Koch ..... 139/91
5,183,082 A * 2/1993 Baumann ..... 139/92

FOREIGN PATENT DOCUMENTS

| | | |
|---|---|---|
| EP | 0 288 652 | 11/1988 |
| EP | 0 457 210 | 11/1991 |
| JP | 60-47942 | 10/1985 |

OTHER PUBLICATIONS

D. Hull, An Introduction to Composite Materials, 1996, Cambridge University Press, 2nd Edition, pp. 9–10.*

* cited by examiner

*Primary Examiner*—John J. Calvert
*Assistant Examiner*—Andrew W. Sutton
(74) *Attorney, Agent, or Firm*—Dykema Gossett PLLC

(57) ABSTRACT

A support element for a heddle frame is formed by profiled pieces (1, 1') at each end that consist of a polymeric material. The profiled pieces (1, 1') are connected to one another at each side by at least two side pieces (2, 2') made of a metallic material. At the inside cavity of the body formed by the profiled pieces (1, 1') and the side pieces (2, 2') there is a separate core (4) arranged, and the inner surfaces of the side pieces (2, 2') are provided with a layer of insulating material.

20 Claims, 1 Drawing Sheet

SUPPORT ELEMENT FOR A HEDDLE FRAME

BACKGROUND OF THE INVENTION

The present invention relates to a support element for a heddle bar, particularly in a heddle frame, and a heddle frame having a support element.

The increasing speeds in modern weaving machines cause over-proportional increasing stresses on the heddle frames.

Accelerations of more than 30 g's occur already now and that clearly exceeds the stress limit of currently known designs.

There is a new approach necessary to find a solution and to respond to the increasing stresses foreseeable in the future. From patent literature and from the few described examples there are attempts disclosed for a solution, which were, however, without success for various reasons. Approaches can be seen in U.S. Pat. Nos. 4,484,604, 4,913,193, and EP 0 457 210 to replace the currently used materials of aluminum and steel with carbon-reinforced synthetic materials. Japanese patent document S60-47942, U.S. Pat. Nos. 4,790,357 and 4,913,194, as well as EP 0 288 652 disclose proposals on how different materials could be combined.

All these approaches have in common the attempt to retrofit the current traditional type of a support bar for heddle frames with a variety of materials. This has the result that many compromises have to be made relative to the employment of high-performance materials, as, for example, carbon-fiber reinforcement in the plastic profiled pieces.

It may be prudent to employ costly materials, such as carbon-fiber reinforced profiled pieces, only where the fibers may be arranged unidirectionally and where the effect is the best for geometrical reasons. The use of such reinforcements must, however, be limited to a minimum, particularly for cost reasons. Therefore, it is clearly sensible, as it is disclosed in U.S. Pat. No. 4,790,357, to manufacture part of the heddle frame of metal, e.g. the side pieces of the support bar.

However, all mentioned proposals follow the current idea in design, which includes the use of the heddle mounting rail as an essential supporting element. This is also reasonably sensible as long as the currently standard systems or shapes of the heddle support bar are kept the same. However, this type of design has the disadvantage that carbon-fiber reinforced profiled pieces can be used really effectively only at one of the outer sides. On the other side is the heddle mounting rail attached and it must be located at a considerably large distance away from the actual supporting profiled piece, according to present systems. Integration of the heddle mounting rail as a support element is sensible as long as the modulus of elasticity of the heddle mounting rail is considerably higher than the one of the remaining materials used for support.

SUMMARY OF THE INVENTION

It is therefore the object of the present invention to provide a support bar for a heddle frame which optimally uses materials according to requirements, i.e., materials which meet the currently existing high requirements for stress and which are limited in quantity to the bare minum because of their weight.

Only materials having a high modulus of elasticity come realistically into consideration to fulfill the requirements of a modern support bar construction relative to its stiffness.

Since the use of steel has to be limited to the bare minimum by reason of weight, polymeric materials are the next choice, preferably reinforced polymeric materials. Correspondingly, there is provided according to the invention a support bar for a heddle frame wherein the support element is formed by profiled pieces at each end and comprising polymeric material whereby the profiled pieces are attached to at least two side pieces that are preferably made of metallic material. The inside of the cavity of the support element, defined by the profiled piece and the side pieces, is filled by a separate core and the inner surfaces of the side pieces are provided with a layer of insulating material.

The profiled pieces at each end are made preferably of reinforced polymer, particularly a fiber-reinforced polymer, and the inner surfaces of the side pieces are coated with an insulating layer comprising a fiber material to the greatest extent. The profiled pieces made of polymers or synthetic material are reinforced with carbon fibers or other very strong fibers whereby it is essential that fibers are inserted which have a high modulus of elasticity.

In the proposed design, it is taken as basis not to include the heddle mounting rail as a supporting element in the construction.

The heddle mounting rail will no longer be considered in the construction of the heddle bar. It must be fastened to the heddle bar of the invention by means that will not influence the construction of the heddle bar. In addition, it offers the possibility to change the traditional heddle mounting rail relative to its shape in a manner whereby it can fulfill the actual function considerably better, namely the holding and guiding of heddles.

Construction of the heddle bar of the invention will therefore be very simple. The plastic profiled pieces are arranged around a rectangular core along the edges thereof, preferably made of honeycomb-shaped material, whereby the profiled pieces are reinforced with unidirectional fibers oriented in the longitudinal direction of the heddle bar. Carbon fibers with a high modulus of elasticity are used for this purpose. On the wide side of the three parts, there are thin formed bodies applied, preferably woven material or a fibrous web, which are first soaked with an adhesive. On the outer side, thin pieces of sheet metal are applied to the fibrous structures that are soaked with an adhesive. All parts are finally glued together in one operational step at a high temperature to achieve the necessary stability.

Possibilities of a large variety are achieved with this inventive embodiment relative to the adjustment of stiffness (rigidity) of the support bar to specific requirements. Thus, the cross-section of the fiber-reinforced profiled piece can be changed without having to change the outer dimensions of the support bar. The pieces of sheet metal on the side, which are preferably made of steel or aluminum, have the great advantage of isotropic material characteristics. There can be achieved the same effect in stability with one single, thin, and therefore, light sheet metal piece, as with a fibrous structure, which would have to be made of several layers with fibers crossing each other at various angles. Fibrous structures have in fact very anisotropic stability characteristics. In spite of its low individual weight, such a fibrous structure becomes heavier than even a comparable sheet metal piece made of steel when at least a semi-isotropic stability behavior is required. Such behavior is necessary for the side pieces, which are exposed to stress (loads) from different directions.

In one preferred embodiment, at least one of the carbon-fiber reinforced plastic profiled pieces is designed having two small projections at the narrow side. These projections serve as positioning aids during assembly of the side components and they make considerably easier the assembly of the parts that have not been glued together yet.

In another preferred embodiment, the fibrous structures are made of glass fibers or aramide fibers whereby the fibrous structures serve as support for the adhesive. It is insignificant whether a fibrous web or woven material is employed. However, it is important that the fibrous structure comprise a non-conductive material. This is optimally achieved with the use of glass fibers. This fibrous structure serves not only as support for the adhesive, but it must form at the same time an insulating layer between the carbon fibers and the sheet metal sides to prevent corrosion effects. Since carbon fibers are more noble than iron, damage by corrosion could develop at the broad surface contact of the carbon fibers with the sheet metal pieces made of steel on the sides.

In comparison, in a metallic honeycomb structure, which is preferably used as a core, insulation is achieved in that a space of approximately 0.5 mm is maintained open between the fiber-reinforced plastic profiled pieces and the honeycomb core.

For the inventive effect, it is insignificant if fibers other than carbon fibers, having a high modulus of elasticity, are used in individual cases as fiber reinforcement for the profiled pieces. Just the same, side pieces made of aluminum could be used in individual cases—or cores made of high-density foam or even wood.

However, inventively advantageous is the employment of materials having isotropic behavior and anisotropic behavior geometrically arranged at locations where specific characteristics of the respective material may be used at best. That means therefore: doing without the heddle mounting rail as supporting element, having the arrangement of fiber-reinforced plastic profiled pieces with their highly anisitropic stability characteristics located far away from the center of gravity of the support bar, and having the arrangement of sheet metal with its great isotropic stability characteristics near the center of gravity of the support bar for the purpose of a mechanical connection of the fiber-reinforced plastic profiled pieces with the solid support bar. Important is furthermore the use of a light but sturdy core. An even surface of the side pieces is assured, even at high stress, by gluing the core to the side pieces. The side pieces can thereby fulfill the objective, even by being thin, to durably attach the fiber-reinforced plastic profiled pieces to form the solid support bar. Finally, an advantage is also the use of a wide-spread fiber structure as adhesive carrier and as an insulating element, according to the invention.

As an adhesive for bonding the fiber-reinforced plastic profiled pieces with the side pieces made of metallic material, there are suitable thermoplastic adhesives as well as partially cross-linkable thermoplastic and duroplastic adhesives, whereby it is only essential that the adhesive has favorable stability characteristics, particularly fatigue strength. In case of cross-linkable adhesive, there are suitable one-component adhesives as well as two-component adhesives, e.g., two-package epoxy resin adhesive. Suitable are adhesives hardening at room temperature as well as adhesives hardening under applied heat, e.g., curing at a range between approximately 50 and 100° Celsius. However, adhesives to be used are not further discussed at this point since adhesives of this type are generally known and they have to be selected according to the characteristics of the fiber-reinforced profiled pieces made of synthetic material.

The invention is described in more detail in relation to the accompanying drawing (FIG. 1).

DETAILED DESCRIPTION OF THE INVENTION

Figure 1:
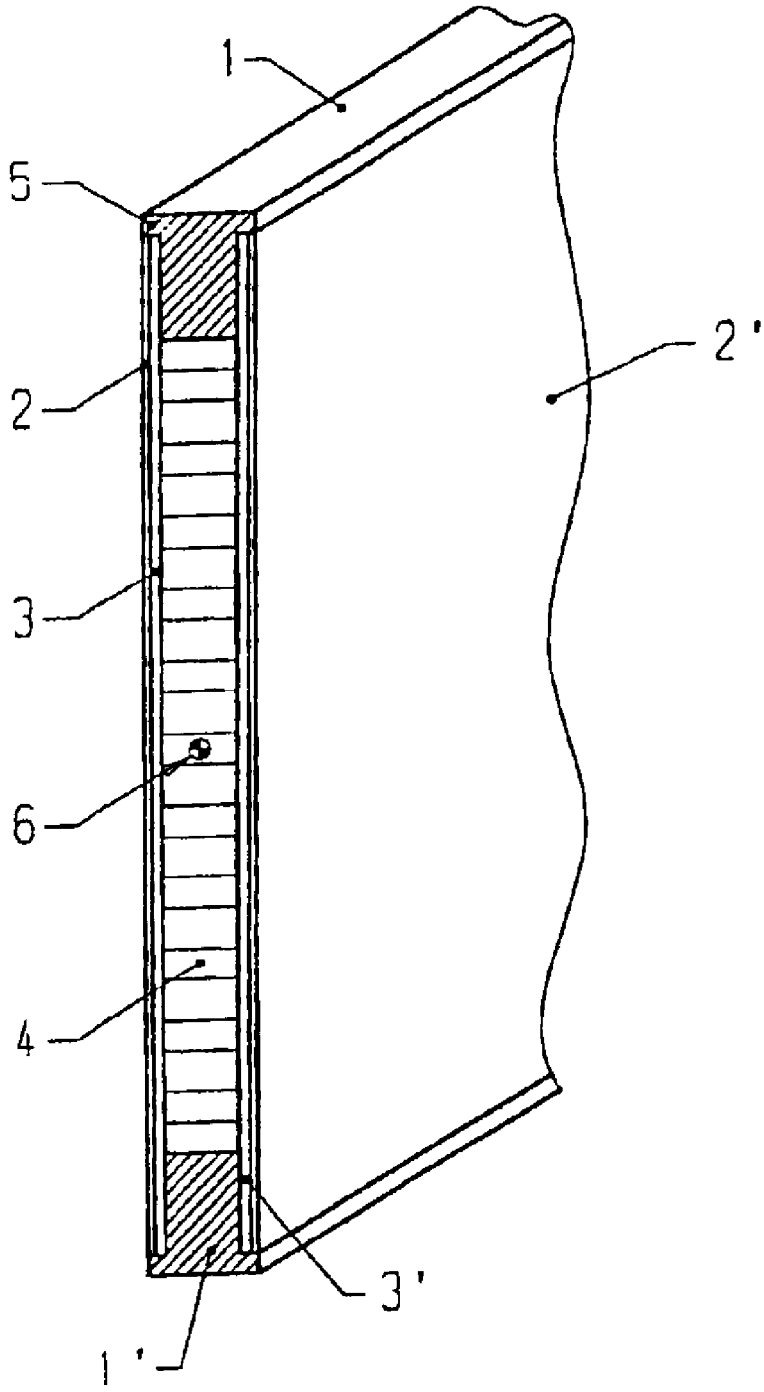
FIG. 1 shows a perspective illustration of part of a support bar for a heddle frame.

The support bar for a heddle frame shown in FIG. 1 has fiber-reinforced plastic profiled pieces 1 and 1' attached along edges of the frame parallel to the central longitudinal axis 6 of the heddle frame, and they contribute through their material characteristics and their positioning to a very high geometrical moment of inertia in the direction of the central axis of the support bar between and parallel to the two profiled pieces.

Side pieces 2 and 2' of the support bar, as well as the fiber structures 3 and 3', are illustrated in the drawing sufficientiy thick for the purpose of clarification. However, both are in reality only 0.7 mm thick, at the most. The rectangular core 4 of the support bar, which serves to stiffen the side pieces, is preferably of honeycomb-shaped material. There can be seen as well the small stop element 5 formed along opposing edges of the side pieces. Fiber structures 3 and 3', oriented in the longitudinal direction of the heddle bar, serve to reinforce side pieces 2 and 2'. The fiber structures may comprise layers of insulating material.

What is claimed is:

1. A support element for a heddle frame having a predetermined height, said support element comprising at least a pair of spaced apart parallel profiled pieces of polymeric material, a pair of spaced apart parallel side pieces of a metallic material secured along opposing side edges of the profiled pieces for interconnecting the profiled pieces together, the profiled pieces and the side pieces together forming a body cavity containing a separate core material, and inner surfaces of said side pieces each being provided with a layer of insulating material, wherein said side pieces have a height generally less than the height of said support element such that said side pieces are not used for structurally supporting a heddle mounting rail.

2. The support element according to claim 1, wherein said profiled pieces are formed of fiber-reinforced polymer material, and each said layer of insulating material is substantially comprised of a fiber material.

3. The support element according to claim 1, wherein each said layer is comprised of a fiber material containing a bonding agent.

4. The support element according to claim 1, wherein said profiled pieces extend in a longitudinal direction of the element, are prefabricated and have reinforcing carbon fibers arranged in said longitudinal direction.

5. The support element according to claim 1, wherein each of said side pieces comprises sheet steel having a thickness of less than 0.4 mm.

6. The support element according to claim 1, wherein said core is comprised of honeycomb-shaped aluminum.

7. The support element according to claim 1, wherein each said layer is comprised of glass fibers secured with a bonding agent.

8. The support element according to claim 1, wherein each said layer is comprised of aramide fibers secured with a bonding agent.

9. The support element according to claim 1, wherein each of said side pieces is comprised of aluminum having a thickness of less than 0.7 mm.

10. The support element according to claim 1, wherein said core is comprised of a high-density foam.

11. The support element according to claim 1, wherein said core is comprised of wood.

12. A support element for a heddle frame having a predetermined height, said support element comprising:

a pair of spaced apart parallel profiled pieces of polymeric material; and a pair of spaced apart parallel side pieces of a metallic material secured along opposing side edges of the profiled pieces for interconnecting the profiled pieces together, the profiled pieces and the side pieces together forming a body cavity containing a separate core material, and inner surfaces of said side pieces each being provided with a layer of insulating material, wherein said side pieces are dimensioned relative to the height of said support element such that said side pieces are not used for structurally supporting a heddle mounting rail.

13. The support element according to claim 12, wherein said profiled pieces are formed of fiber-reinforced polymer material, and each said layer of insulating material is substantially comprised of a fiber material.

14. The support element according to claim 12, wherein each said layer is comprised of a fiber material containing a bonding agent.

15. The support element according to claim 12, wherein said profiled pieces extend in a longitudinal direction of the element, are prefabricated and have reinforcing carbon fibers arranged in said longitudinal direction.

16. The support element according to claim 12, wherein each of said side pieces comprises sheet steel having a thickness of less than 0.4 mm.

17. The support element according to claim 12, wherein said core is comprised of honeycomb-shaped aluminum.

18. The support element according to claim 12, wherein each said layer is comprised of glass fibers secured with a bonding agent.

19. The support element according to claim 12, wherein each said layer is comprised of aramide fibers secured with a bonding agent.

20. The support element according to claim 12, wherein each of said side pieces is comprised of aluminum having a thickness of less than 0.7 mm.

* * * * *